US006698148B1

(12) United States Patent
Manna et al.

(10) Patent No.: US 6,698,148 B1
(45) Date of Patent: Mar. 2, 2004

(54) DEMOUNTABLE MODULAR FLOOR FOR WATERTIGHT RAISED DECKS

(75) Inventors: Biagio Carlo Manna, Rome (IT); Luciano Spellucci, Rome (IT)

(73) Assignee: Fast Park Sistema, S.r.l., Rome (IT)

( * ) Notice: Subject to any disclaimer, the term of this patent is extended or adjusted under 35 U.S.C. 154(b) by 0 days.

(21) Appl. No.: 09/937,235

(22) PCT Filed: Mar. 23, 2000

(86) PCT No.: PCT/IT00/00103

§ 371 (c)(1),
(2), (4) Date: Sep. 24, 2001

(87) PCT Pub. No.: WO00/58583

PCT Pub. Date: Oct. 5, 2000

(51) Int. Cl.[7] ..... E04B 1/70; E04B 5/00

(52) U.S. Cl. ..... 52/302.1; 52/329; 52/335; 52/338; 119/450

(58) Field of Search ..... 52/302.1, 329, 52/335, 338, 302.2, 302.3, 302.4, 302.5, 302.6, 302.7; 119/450

(56) References Cited

U.S. PATENT DOCUMENTS 4,114,335 A * 9/1978 Carroll ..... 52/336
5,511,351 A * 4/1996 Moore ..... 52/302.1
5,941,035 A * 8/1999 Purse ..... 52/263
6,129,838 A * 10/2000 Millner ..... 210/164
6,397,539 B1 * 6/2002 Kimura ..... 52/302.4

FOREIGN PATENT DOCUMENTS

| | | | |
|---|---|---|---|
| EP | 364414 | | 4/1990 |
| FR | 928767 | | 12/1947 |
| JP | 5-33507 | * | 2/1993 |
| JP | 5-125802 | * | 5/1993 |

* cited by examiner

*Primary Examiner*—Jeanette Chapman
(74) *Attorney, Agent, or Firm*—Samuels, Gauthier & Stevens

(57) ABSTRACT

A demountable modular floor for watertight raised decks consisting of a plurality of modularly assemblable composite slabs made of steel sheet and concrete, provided with a drainage system for collecting and conveying the rainwater between the slabs, wherein each composite slab comprises a bottom element (1) made of corrugated metal sheet surrounded by four suitably shaped metal sections (2, 3) and filled with a concrete layer (14), as well as four segments of upwardly open gutters (6, 7) peripherally arranged around said composite slab. The structure is completed by grid elements (8) covering the gutters (6) of larger width. The floor structure allows a rapid setting up of the raised deck and, at the same time, it affords the total dismantling thereof and prevents any seepage or leakage of water towards the underlying area.

17 Claims, 4 Drawing Sheets

DEMOUNTABLE MODULAR FLOOR FOR WATERTIGHT RAISED DECKS

The present invention relates to a demountable modular floor for watertight raised decks. More particularly, this invention relates to a floor structure consisting of a plurality of modularly assemblable composite slabs made of steel sheet and concrete provided with a drainage system for collecting and conveying the rainwater between the slabs. Such floor structure allows a rapid setting up of the raised deck and, at the same time, it affords the total dismantling thereof and prevents any seepage or leakage of water towards the underlying area.

As it is known, constructions of one or more raised floors or decks suited to be set up in a short time and with restricted economic resources are becoming quite interesting particularly for building more or less temporary parking lots, as an alternative to conventional multistorey underground and/or raised car park constructions. If it is desired to maximise the advantages offered by such structures, however, it is necessary that the assembling times and costs be really competitive, without any negative impact on the quality and duration of the resulting work.

A structure that allows the above objects to be achieved is disclosed in the European patent No. 0364414, owned by the instant Applicant. Such patent concerns a modular system that can be easily assembled for setting up in extremely short times a raised floor to be used as a parking place for cars, and that can also be disassembled and recovered for reutilisation, for instance in a different location. The structure substantially consists of modular units each of which comprises a rectangular or square composite floor element, surrounded by four edge beams and held up at its corners by four vertical supporting elements or pillars that bear said edge beams through corresponding node elements or capitals, special bases for resting on the ground being provided under said vertical supporting elements, while a system of ties and/or struts transversely strengthens the structure.

Each of said vertical supporting elements ends, at a level corresponding to the base, in a threaded joint suited to enable the total length of the vertical element to be adjusted. Said base also comprises a hinge device, particularly consisting of a spherical joint, enabling the base plate to lie down according to the slope of the ground surface, while the overlying supporting element may take a perfectly vertical position. This double adjustment system makes it possible to install the modular structure also on not previously levelled, uneven grounds, and with no need to provide any foundation works. Thus, the concerned structure is set up by assembling the modular units beside one another, with adjacent modules sharing in turn the relevant beams and supporting elements, so as to obtain a raised deck suitable for use as a parking lot, taking any desired shape and size.

In the illustrative embodiments disclosed in the European patent No. 0364414, the modular slabs of the floor are made of a double layer consisting of a corrugated steel sheet of suitable thickness as the load-bearing component, covered by a panel of light and strong material as the paving component, preferably made of suitably treated ply-wood. This approach is proposed in order to allow the use of light elements, to be assembled on the same site where the parking structure is to be built, such elements involving relatively reduced transportation costs and being easily moved within the building yard, by hand or by small lifting trucks.

In the practical construction of modular parking lots according to the above patent provided with composite floors of corrugated steel sheet and wood (preferably birch ply-wood, treated with synthetic resins for waterproofing purposes), the wood panel is connected to the underlying steel sheet by means of metal channel sections with a omega(Ω)-shaped cross-section, that are mounted along the edges of two adjacent panels. The omega-shaped channels are perforated in the groove portion of the section in order to enable their connection to the underlying corrugated steel sheet by means of bolts. The corrugated steel sheet, in turn, is correspondingly perforated along the contact area with the omega-shaped section. This method of mounting the wood panels (aimed, as it is apparent, at assuring the full demountability of the composite floor slabs) results in avoiding any need to perforate the treated wood panel, but, on the other hand, it necessarily involves the perforation of the load-bearing corrugated steel sheet on the building yard.

The corrugated steel sheet is also utilised, in the above-mentioned embodiments, to collect the rainwater under the said wood panel. As the floor is laid slightly slanting by acting on the length of the adjustable pillars of the structure, the water can be conveyed, flowing in the channels of the corrugated sheet, toward one or more peripheral edges of the raised deck, to be collected in edge eaves having conduits branching therefrom for drainage on the ground.

The embodiment with composite floor made of corrugated steel sheet and wood is especially advantageous in view of the relative ease of transportation of the construction components, which allows not to increase too much the construction costs in case of installations in sites very far from the factory or only reachable by sea. Furthermore, such approach has been found to be effective in respect of the modular versatility, that results from the possibility of easily cutting the floor component on the building yard in order to accommodate any size variation of the structural module. Actually, it should be noted that the concerned structure, although being commercially proposed with a standard modularity, should also be such as to meet the various requirements that can be put forward in particular cases. By way of example, the modular structure should be adapted to fulfil the various national rules in respect of the standard size of the vehicle parking stalls or of the roadway width for manoeuvring the vehicles.

In spite of the above advantages, however, the floor slab made of metal sheet and wood panels has the drawback of not affording a long durability of the parking surface, firstly, in view of the need to perforate the steel sheet for connecting it with the metal sections holding the wood panels in place. The perforation makes the steel sheet subject to corrosion and, as said operation is necessarily carried out during the assembling stage, it is not possible to perform a new galvanisation process on the metal sheet after perforation. The corrosive attack is remarkably enhanced not only by the rainwater that is collected within the corrugated steel sheet, but also by the condensate forming in a conspicuous amount in the contact area between the steel sheet and the panel. Secondly, the durability of the floor is strongly jeopardised by the scarce wear resistance of the wooden paving surface, notwithstanding any previous treatment of such surface. In strict dependence on the overall utilisation of the parking structure and on their location in the paving area, the wood panels are subject to such a wear deterioration as to make it often necessary to substitute the damaged ones, especially on the aisles and on the manoeuvring areas.

A further critical element is due to the fact that the wood panel mounted on the corrugated metal sheet makes the floor highly noisy at the passage of the vehicles thereupon, because the coupling of the two above elements together acts as a resonance box.

A second approach considered for producing the floor of the structure according to the European patent No. 0364414 involves the use of single precast elements of reinforced concrete, to be manufactured in factory and to be installed in nearly finished condition. In this case, the reinforced concrete slabs or plates forming the modular units of the floor are cast in suitably shaped metal formworks. Holes and further engagement means are provided in the moulding in order to enable the resulting piece to be removed from the metal formwork upon setting, as well as for transportation and installation purposes.

The concerned concrete slabs are mounted on the bearing structures of the modular parking structure without any casting on the installation site, so as to afford a complete reutilisation of the materials when the parking structure is to be disassembled and transferred. Any connection between the elements, therefore, should not be permanent and, at the same time, it should enable the rainwater to be collected and to flow down without causing any leakage on the underlying area. To this aim, water collecting gutters and eaves are provided between the slabs, covered by an upper metal grid and extending in a first one of the two directions of the lattice formed by the floor slabs arranged side by side. In the direction orthogonal to the first one, conversely, a joint between adjacent slabs is provided by means of complementary steps having a sealing gasket interposed therebetween. Further, in order to improve the sealing effect, the vertical slit between two adjacent slabs is filled with an easily removable sealing material.

The proposed system eliminates the main drawbacks of the first floor system described above, firstly because the thickness and the compactness of the concrete panel actually eliminate the noisiness problem. Secondly, any wear of the paving surface, made of a cement-based material, is noticeably reduced, also by virtue of a layer of resin or of a bituminous conglomerate which is laid upon the concrete to protect it both from wear due to running vehicles and from the rainwater.

However, the floor structure made of precast reinforced concrete is not free from other drawbacks. Among these, particularly critical have been found to be the cost of transporting the slabs from the manufacturing site, the extension of the overall construction time of the parking structure or, conversely, the immobilisation of the precast products on the manufacturing site and/or the need to have a high number of metal formworks available. Actually, the transportation of precast reinforced concrete slabs of suitable size for them to be utilised as modular elements of raised decks of rapidly assemblable parking structures is quite expensive: normally, no more than twelve elements can be loaded in each container, with resulting multiplication of the transport runs as well as of the costs connected with the installation of such structures far away from the manufacturing site.

As far as the precasting problems are concerned, it is apparent that, in order to fulfil in a short time the production request for a work having the size of a parking lot, it is necessary to have a large number of formworks available for simultaneous utilisation, this requiring a large working surface available on the production site and, in addition, a remarkable capital investment for producing the formworks. On the other hand, having recourse to any advanced production of the workpieces necessarily requires a large storage area and a remarkable capital immobilisation, in addition to raising the problem of production flexibility in respect of any "non standard" size of the requested slabs.

As far as the latter problem is concerned, it should be noted that not only the size of the requested modular elements is subject to variations due to the foregoing reasons, but, in addition, a further variable aspect is introduced by the possibility of coating the concrete slab with either a layer of bituminous material or a thin film of protective resin. Since, for obvious reasons of wear resistance, the concrete slab is provided with a peripheral, built-in metal section, it is necessary to foresee in the precast production a top layer not filled with concrete having a thickness variable according to the circumstances.

A further drawback of the concrete modular floor described above has been found to be the unsatisfactory tightness of the junction between adjacent slabs as realised by a step joint with interposed sealing gasket. Actually, in this case the sealing of the step joint is effected after assembling the concrete panels and, as a joint of noticeable linear extension is involved, the possibility of defects and leakage is not negligible. Even if a final check of the tightness is performed by means of an "artificial flooding" upon installation, the possibility of settlement of the metal structure during the first period following installation—also due to the passage of the first vehicles—does not offer any guarantee against possible seepage or leakage of water, that should be individually located and eliminated as they arise.

In view of the foregoing, it is an object of the present invention to provide a modular platform structure for raised decks suitable for bearing the load, in particular, of a vehicle parking lot, which structure can be easily and rapidly assembled when installing the work and can be equally easily disassembled, is reusable, durable and not subject to undue deterioration in use. In addition, such structure should allow to keep the transportation cost to a minimum when setting up the work and, although being readily demountable, should prevent any seepage or leakage of water towards the underlying area. Furthermore, the floor structure should allow a sufficient flexibility to be achieved with respect to the module size and to the type of final coating of the paving surface.

To achieve such purpose, this invention takes advantage of the conventional technology of construction of continuous load-bearing floors made of corrugated metal sheet filled with a layer of—usually reinforced—concrete, cast on the corrugated metal sheet. The latter acts both as a confining surface for the fluid concrete and as a component element of the final composite structure. According to the invention, each of the modular slab elements making up the raised deck can be directly and rapidly produced on the installation site by arranging a steel "box" with a bottom of corrugated metal sheet and four walls formed by suitable metal sections (that, as such, are easily transportable and have adjustable dimensions) and by casting the concrete in such metal "box" directly on the final location of the floor slab. In addition, according to this invention, the connections between the various slab elements forming the raised deck are not provided by sealing means aimed at preventing water from passing therethrough, but, on the contrary, they are entirely provided, on all sides of the slabs, by conveying means arranged for collecting such water—rather than attempting to stop it—and for conveying it to the relevant drains.

Accordingly, the present invention specifically provides a demountable modular floor for raised decks consisting of modular quadrilateral units, each of which comprising:

a composite floor slab with a bottom element made of corrugated metal sheet (consisting of one or more pieces, according to the size) surrounded by four metal sections forming the side walls of said slab, and a layer of concrete cast on said bottom element of corrugated metal sheet and confined by said side walls, said metal sections forming said side walls having a cross-section substantially in the shape of a Z or of an S with square loops, and four segments of upwardly open gutters, peripherally arranged around said composite floor slab and adjacent to said side wall sections, housed in the channels defined by pairs of side wall sections belonging to adjacent composite floor slabs.

Preferably, the upper, substantially horizontal, side of each of said Z-shaped or square loop S-shaped side wall sections is prolonged by a fin that is bent downwards and overhangs the respective gutter, so as to act as a drip. Such an arrangement allows the water flowing on the horizontal upper side of said side wall sections to vertically drop in the collecting gutter placed therebelow, rather than adhering to and flowing on the section extrados.

According to a preferred embodiment of this invention, the side wall sections of the composite slab that are parallel to the fold lines of said corrugated metal sheet of the bottom element have a substantially Z-shaped cross-section and the corresponding gutter segments are interposed between the vertical external sides of two of said Z-shaped side wall sections belonging to adjacent composite floor slabs. Again according to a preferred embodiment, the side wall sections that are orthogonal to the fold lines of said corrugated metal sheet have a substantially S-shaped cross-section with square loops, and the corresponding gutters are laid upon the intermediate, substantially horizontal, sides of two of said square loop S-shaped side wall sections belonging to adjacent composite floor slabs.

Further structural and functional features of the modular floor according to the invention are specified in the further dependent claims. According to another aspect thereof, this invention further provides, in addition to the final floor structure that can be realised by exploiting the above criteria, the set of elements that are assembled on the work site for building the raised deck, to be completed by simply casting concrete and subsequently applying a protective coating thereon. Therefore, the present invention also specifically provides an assemblable system on the work site for setting up demountable modular floors for raised decks consisting of quadrilateral modular units, which system comprises:

for each of said modular units, a quadrilateral element made of corrugated metal sheet (consisting of one or more pieces, according to the size) and four metal sections each having a length corresponding to one side of said corrugated metal sheet element, said metal sections having a cross-section substantially in the shape of a Z or of an S with square loops, each of said metal sections being suited to be coupled to a corresponding side of said corrugated metal sheet element;

two segments of main upwardly open gutters, suited to extend along one or more of said modular units and to be housed in the channels defined by pairs of metal sections belonging to adjacent modular units; and two secondary upwardly open gutters, each having a length corresponding to one modular unit, suited to be housed in the channels defined by pairs of metal sections belonging to adjacent modular units.

It will be apparent that, even if it can be advantageously transported as separate component elements and assembled for casting concrete directly on the work site, the system of this invention can also be utilised, according to any specific requirements, for manufacturing the composite floor slabs away from the installation site, e.g., directly in the factory or in a suitable area within the building yard.

Also as regards the assemblable system, the additional structural features of this invention are recited in the dependent claims. The said features, as well as the advantages of the invention, will be clearer with reference to a specific embodiment thereof, which is shown by way of example only in the accompanying drawings, wherein:

Figure 1:
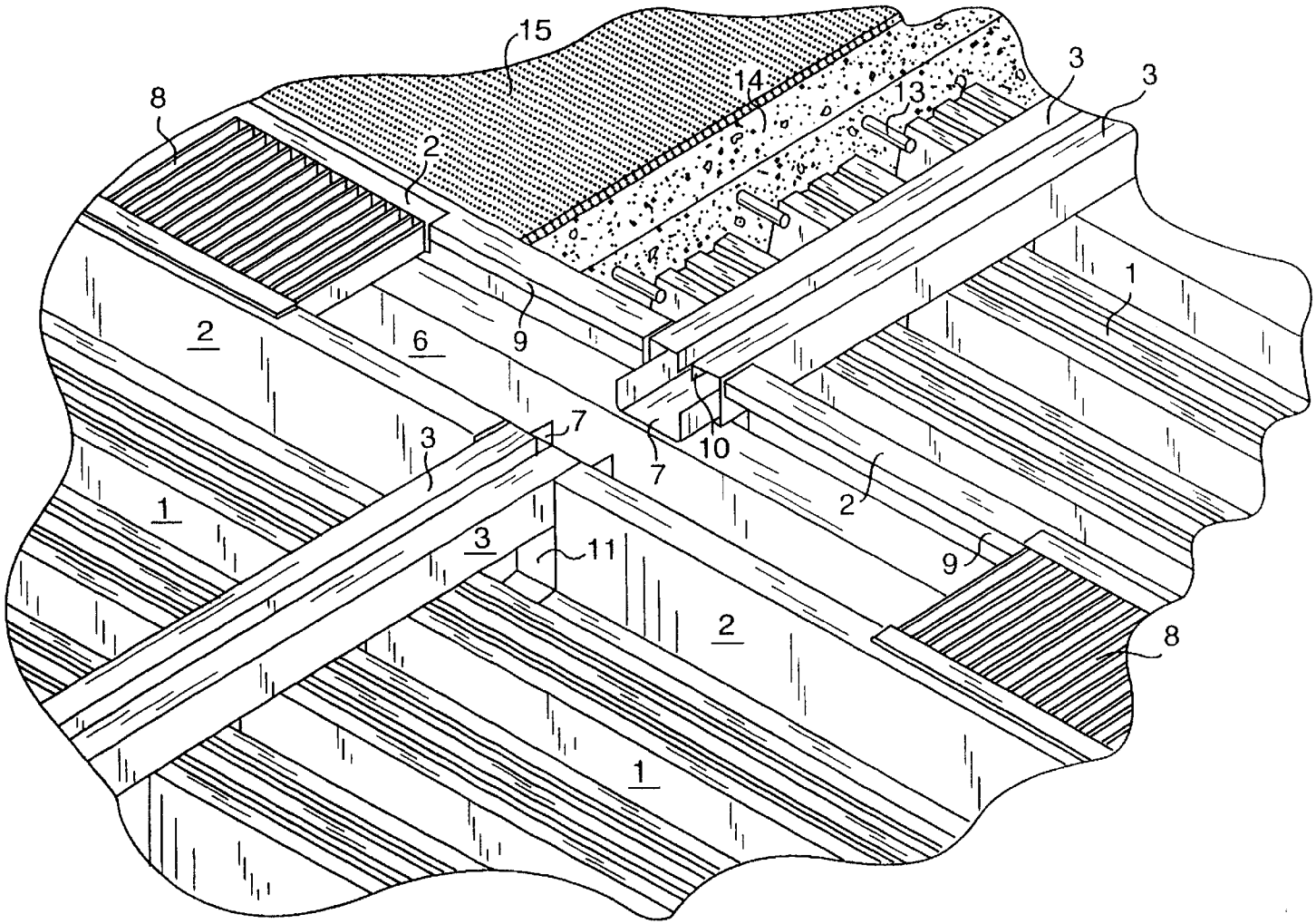
FIG. 1 is a partial perspective view of an embodiment of the demountable modular floor according to this invention, partially devoid of the concrete moulding.
Figure 2:
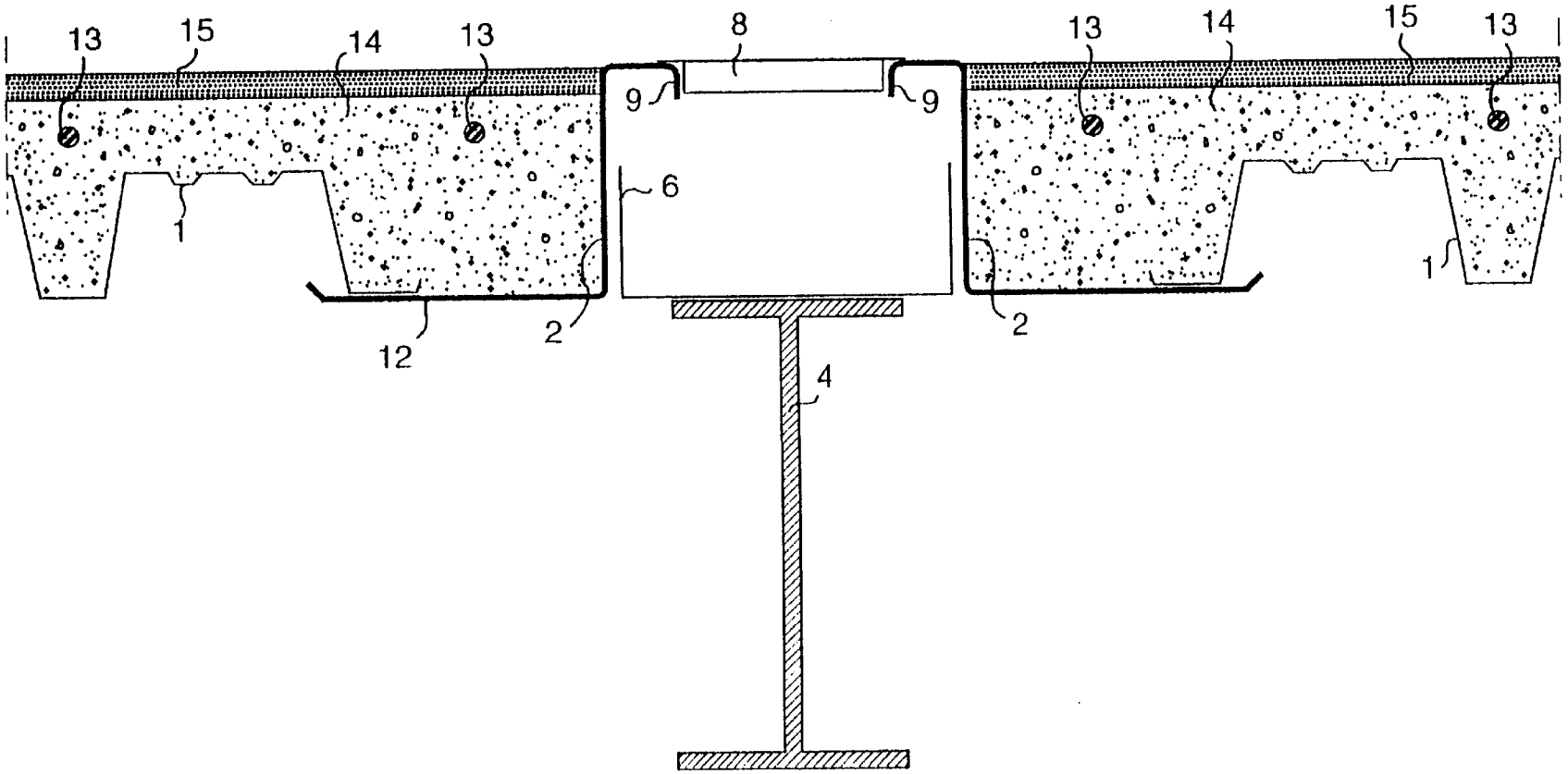
FIGS. 2 and 3 are two vertical cross-sectional views of a portion of the floor of FIG. 1, after the concrete casting and the final coating, respectively taken along a plane orthogonal to the fold lines of the corrugated metal sheet and along a plane parallel to said lines.
Figure 3:
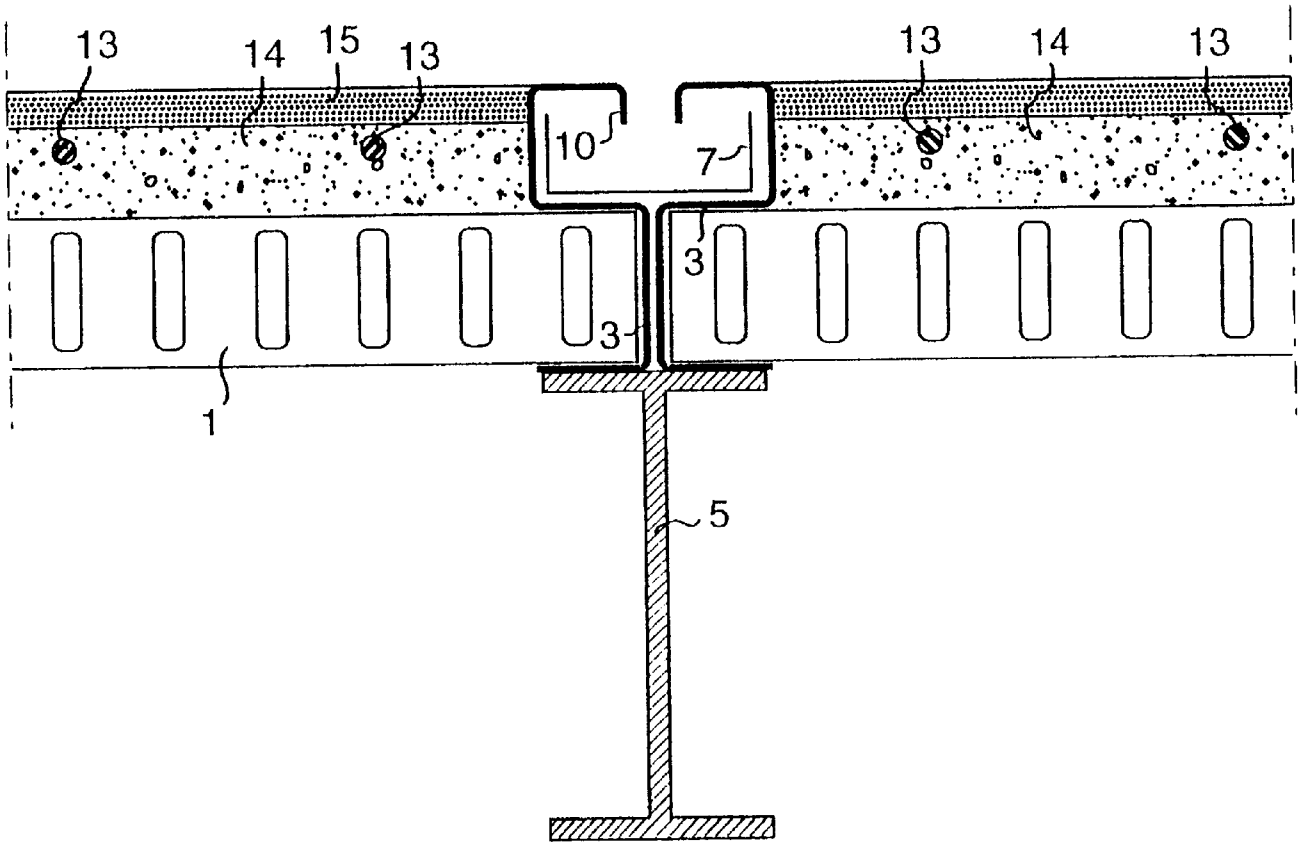

As it is shown in FIGS. 1–3, the demountable modular floor according to this invention is made up by a plurality of quadrilateral composite floor slabs, arranged side-by-side, the bottom of which consists of elements (1) of corrugated metal sheet (directly visible in FIG. 1, that partially shows the structure before concrete casting), and the side walls of which are made up by four metal sections (2, 3) forming two couples of different shape. In particular, two substantially Z-shaped sections (2) (better illustrated in FIG. 2) are arranged at the edges of the corrugated metal sheet bottom elements (1) along the sides of the slab parallel to the fold lines of said metal sheet, while two substantially S-shaped sections (3), the cross-section of which is in the shape of an S with square loops, (better illustrated in FIG. 3) are provided along the two orthogonal sides. The metal "boxes" formed by the bottom element (1) of corrugated metal sheet and by said side wall sections (2, 3) are preferably assembled at the level of the raised deck, by directly overlaying them on the horizontal network of the beams (4, 5) of said modular structure. In the case shown, as it can be observed in FIGS. 3 and 2, the square loop S-shaped sections (3) are directly laid upon the upper wings of the corresponding beam (5). The Z-shaped sections (2) are laid with their ends on the same beam (5) (besides any other intermediate supporting points), since the upper wing of the beam (4) parallel to said Z-shaped sections (2) is taken up by the main gutter (6) provided for water collection.

Actually, the shape and the relative locations of two Z-shaped side wall sections (2) belonging to two adjacent floor slabs are such that a room is left therebetween for housing the main gutters (6). The latter extend in parallel direction with respect to the fold lines of the corrugated metal sheet of the bottom element (1) and are to be directly laid upon the wings of the corresponding beams (4) in order to be positioned at a minimum level for collecting the water. As it is shown in FIG. 1, said main gutters (6) can be extended without interruptions along multiple modular units. On the other hand, the square loop S-shaped side wall sections (3) have a shape and relative locations such as to enable the secondary gutters (7) to be positioned upon their horizontal intermediate sides, in order that said secondary gutters (7) be located at a higher level with respect to the main gutters (6) and may discharge the collected water therein. Since they meet on both their ends with the main gutters (6), the secondary gutters (7) extend for a length corresponding to the dimension of one modular floor slab, preferably with a slight protrusion beyond the vertical walls of the main gutters (6).

As it can be observed in FIGS. 1 and 3, the height of the lower vertical sides of said square loop S-shaped side wall sections (3) is such as to enable the edges of the corrugated metal sheet of the bottom element (1) to be inserted into the lower channel of said wall sections (3). Therefore, said height is not less than the overall thickness of said corrugated metal sheet. The horizontal upper sides of said square loop S-shaped side wall sections (3) are prolonged so as to almost completely cover (with the facing sections belonging to two adjacent floor slabs) the corresponding secondary gutter (7). Such design aims at eliminating any need to provide for additional elements to cover the joint between two adjacent floor slabs so as to make the floor sufficiently continuous. Obviously, such horizontal sides should have a limited width, in order not to bend under the weight of any concentrated load on the floor, such as, for instance, the load due to the wheels of a vehicle.

The same above considerations apply to the upper horizontal sides of the Z-shaped side wall sections (2), which have a limited width. Specifically, such width is quite less than half the width of the underlying main gutter (6) and the room between the upper sides of two Z-shaped side wall sections (2) belonging to adjacent composite floor slabs is covered by a grid element (8) overlaying the main gutter (6) and resting with its two longitudinal edges on the upper sides of said Z-shaped side wall sections (2).

Figure 4:
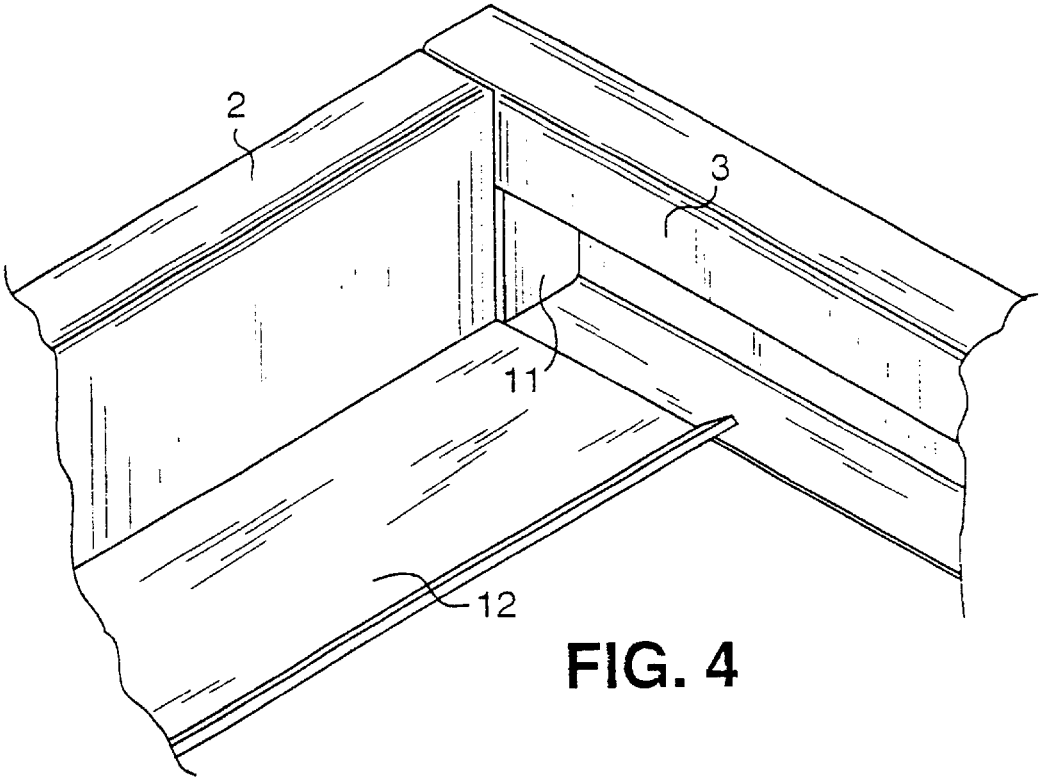
FIG. 4 is a perspective partial view of two angularly coupled side wall sections of the floor of FIG. 1, as they can be seen from inside.
Figure 5:
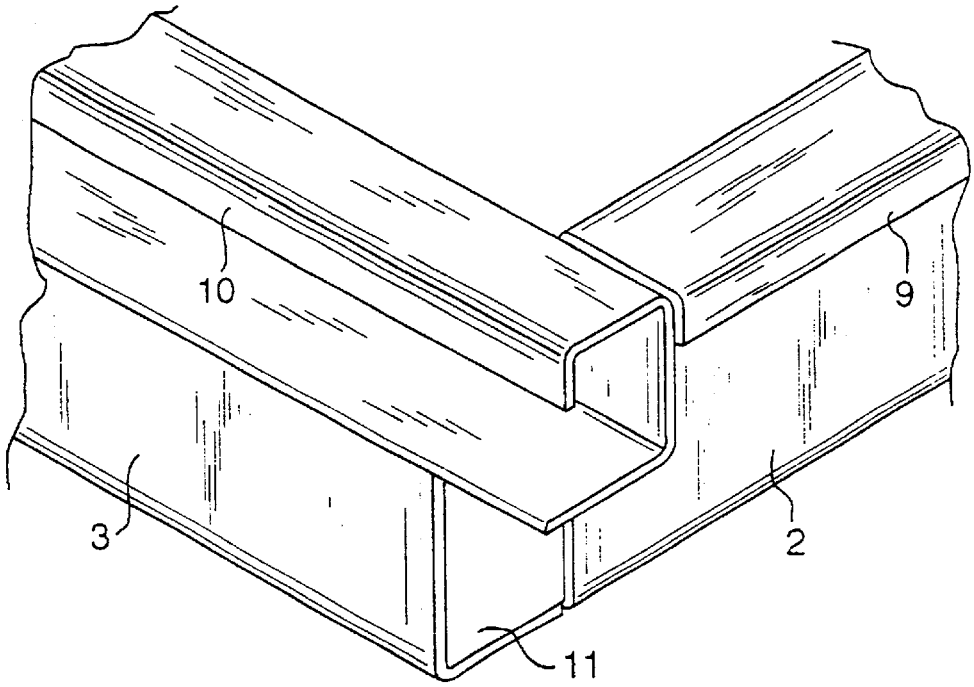
FIG. 5 is a perspective partial view of the same two side wall sections of FIG. 4, as they can be seen from outside.

Both in said Z-shaped side wall sections (2) and in said square loop S-shaped side wall sections (3), the upper side is prolonged by a fin (9, 10) that is bent downwards and overhangs the respective gutter (6, 7), so as to act as a drip. The detailed configuration of said two side wall sections (2, 3), as well as their joints at the corners of the composite floor slab, are shown in FIGS. 4 and 5. In detail, FIG. 5, depicting the angular segment as it can be seen from outside, clearly shows the two drip fins (9, 10). Aiming at preventing the fluid concrete from outflowing during the manufacturing stage, the corners between said side wall sections (2, 3) are provided with a closure end plate (11) for the lower channel of said square loop S-shaped side wall section (3). Said closure end plate (11) is preferably attached by welding. As it is shown in FIG. 5, the square loop S-shaped side wall section (3) is preferably cut with the upper channel slightly prolonged, in order to better house and support the secondary gutter (7). A further particular feature more clearly shown in detail resides in that the Z-shaped side wall sections (2) preferably have asymmetrical cross-section, with a lower horizontal side (12) remarkably larger than the upper horizontal side. This aids coupling it to the corrugated metal sheet of the bottom elements (1), because it enables to accommodate the variable position of the terminal descending segment of the metal sheet, which can be different according to the size of the corrugated metal sheet employed, as well as to its pitch.

As it is shown in FIGS. 1–3, one or more steel reinforcing elements (13) can be arranged within the metal "boxes" prepared as above described, for instance in the form of a metal wire network and/or steel rods. Upon positioning said reinforcing elements (13), the casting operation of the concrete layer (14) can be carried out to fill the "boxes" up to the desired level. Such level depends on the choice of the final protective layer to be applied upon the concrete layer (14). In the embodiment shown, a coating layer (15) of bituminous conglomerate is provided upon the concrete layer (14), such coating layer (15) being applied in a sufficient thickness to level off the upper surface of the concerned composite floor slab. As already remarked, instead of said layer of bituminous conglomerate, also very thin protective coatings can be provided, such as waterproofing resins: it will be apparent that the possibility of carrying out the concrete casting on the work site allows to adjust at any time the thickness of such layer according to the pre-selected final coating type.

The present invention has been disclosed with particular reference to some specific embodiments thereof, but it should be understood that modifications and changes may be made by the persons skilled in the art without departing from the scope of the invention as defined in the appended claims.

What is claimed is:

1. A demountable modular floor for raised decks consisting of modular quadrilateral units, each of which comprising:

a composite floor slab with a bottom element made of corrugated metal sheet, consisting of one or more pieces, according to the size, surrounded by four metal sections forming the side walls of said slab, and a layer of concrete cast on said bottom element of corrugated metal sheet and confined by said side walls, said metal sections forming said side walls having a cross-section substantially in the shape of a Z or of an S with square loops, and four segments of upwardly open gutters, peripherally arranged around said composite floor slab and adjacent to said side wall sections, housed in channels defined by pairs of side wall sections belonging to adjacent composite floor slabs.

2. A modular floor according to claim 1, wherein the upper, substantially horizontal, side of each of said Z-shaped or square loop S-shaped side wall sections is prolonged by a fin that is bent downwards and overhangs the gutter.

3. A modular floor according to claim 1, wherein said side wall sections that are parallel to fold lines of said corrugated metal sheet of the bottom element have a substantially Z-shaped cross-section and the gutter segments are interposed between the vertical external sides of two of said Z-shaped side wall sections belonging to adjacent composite floor slabs.

4. A modular floor according to claim 3, wherein said side wall sections that are orthogonal to the fold lines of said corrugated metal sheet of the bottom element have a substantially S-shaped cross-section with square loops and the gutters are laid upon the intermediate substantially horizontal sides of two of said square loop S-shaped side wall sections belonging to adjacent composite floor slabs.

5. A modular floor according to claim 4, wherein the height of the lower vertical sides of said square loop S-shaped side wall sections is not less than the overall thickness of said bottom element of corrugated metal sheet, the edges of said bottom elements being inserted into the lower channel of the respective square loop S-shaped side wall sections.

6. A modular floor according to claim 4, wherein main gutters adjacent to said Z-shaped side wall sections are formed by continuous gutter segments extending along two or more one modular units, while secondary gutters adjacent to said square loop S-shaped side wall sections have a length corresponding to one modular unit, are located at a level higher than the level of said main gutters and their end is open over said main gutters.

7. A modular floor according to claim 6, wherein the width of the upper, substantially horizontal, side of each of said Z-shaped side wall sections is less than half the width of the underlying main gutter and the room between the upper sides of two Z-shaped side wall sections belonging to adjacent composite floor slabs is covered by a grid element laid over said main gutter and resting with its two longitudinal edges on the upper sides of said Z-shaped side wall sections.

8. A modular floor according to claim 3, wherein said Z-shaped side wall sections have asymmetrical cross-section, with a lower, substantially horizontal side remarkably wider than the upper, substantially horizontal side.

9. A modular floor according to claim 1, wherein said concrete layer incorporates one or more steel reinforcement elements.

10. A modular floor according to claim 1, wherein each of said composite floor slabs further comprises a protective coating layer on said concrete layer.

11. A modular floor according to claim 10, wherein said coating layer is made of bituminous material, resin material or cement-based material.

12. A modular floor according claim 11, wherein the sum of the thicknesses of said concrete layer cast on said corrugated metal sheet bottom element and confined by said side wall sections and of said protective coating layer is such that the upper surface of said coating layer is placed substantially at the same level as the substantially horizontal upper sides of said side wall sections.

13. A system assemblable on the work site for setting up demountable modular floors for raised decks consisting of quadrilateral modular units, which system comprises:

for each of said modular units, a quadrilateral element made of corrugated metal sheet, consisting of one or more pieces, according to the size, and four metal sections each having a length corresponding to one side of said corrugated metal element, said metal sections having a cross-section substantially in the shape of a Z or of an S with square loops, each of said metal sections being suited to be coupled to a corresponding side of said corrugated metal sheet element;

two segments of main upwardly open gutters suited to extend along one or more of said modular units and to be housed in the channels defined by pairs of metal sections belonging to adjacent modular units; and two secondary upwardly open gutters, each having a length corresponding to one modular unit, suited to be housed in the channels defined by pairs of metal sections belonging to adjacent modular units.

14. A system according to claim 13, wherein two of said four metal sections have substantially Z-shaped cross-section and are suited to be coupled to the sides of said corrugated metal sheet element parallel to its fold lines.

15. A system according to claim 14, wherein the other two of said four metal sections have a substantially S-shaped cross-section with square loops and are suited to be coupled to the sides of said corrugated metal sheet element orthogonal to its fold lines.

16. A system according to claim 15, wherein said square loop S-shaped sections are suited to house said secondary gutters upon the intermediate substantially horizontal sides of two of said square loop S-shaped sections belonging to adjacent modular units.

17. A system according to claim 16, further comprising two segments of a grid element suited to extend along one or more of said modular units over said main gutters, and to rest with their longitudinal edges on the upper sides of said Z-shaped sections.

* * * * *